United States Patent [19]

Karnezos et al.

[11] Patent Number: 4,862,490

[45] Date of Patent: Aug. 29, 1989

[54] VACUUM WINDOWS FOR SOFT X-RAY MACHINES

[75] Inventors: Marcos Karnezos, Palo Alto; Randal S. Jones, Los Altos, both of Calif.

[73] Assignee: Hewlett-Packard Company, Palo Alto, Calif.

[21] Appl. No.: 162,107

[22] Filed: Feb. 29, 1988

Related U.S. Application Data

[63] Continuation-in-part of Ser. No. 921,994, Oct. 23, 1986.

[51] Int. Cl.[4] ..... G21K 1/00

[52] U.S. Cl. ..... 378/161; 378/140; 378/35

[58] Field of Search ..... 378/35, 161, 140

[56] References Cited

U.S. PATENT DOCUMENTS 4,393,127 7/1983 Greschner et al. ..... 378/161
4,587,184 5/1986 Schneider-Gmelch et al. ..... 378/35
4,608,326 8/1986 Neukermans et al. ..... 378/35
4,780,382 10/1988 Stengl et al. ..... 378/35

FOREIGN PATENT DOCUMENTS 0934002 10/1955 Fed. Rep. of Germany ..... 378/140
0095093 6/1982 Japan ..... 378/140

*Primary Examiner*—Janice A. Howell
*Assistant Examiner*—David P. Porta
*Attorney, Agent, or Firm*—Cushman, Darby & Cushman

[57] ABSTRACT

A vacuum window including a support substrate provided with a window aperture, and a membrane attached to a front surface of the substrate. The membrane has a relatively thick perimeter portion attached to the support substrate, and has a window portion aligned with the window aperture. The window portion of the membrane includes a number of relatively thin pane sections separated by relatively thick, structural rib sections. The membrane material is preferably boron nitride, boron carbide, or silicon carbide.

15 Claims, 1 Drawing Sheet

VACUUM WINDOWS FOR SOFT X-RAY MACHINES

RELATED CASES

The present invention is a continuation-in-part invention of U.S. patent application Ser. No. 921,994 filed Oct. 23, 1986.

BACKGROUND OF THE INVENTION

This invention relates to x-ray machines, and more particularly, to vacuum windows for x-ray machines.

DESCRIPTION OF THE PRIOR ART

X-rays can be generated by the bombardment of a metal target by a beam of electrons. By necessity, the target and electron beam are contained within an evacuated chamber for the proper generation and acceleration of the electron beam.

X-rays comprise electromagnetic radiation of extremely short wavelength. "Hard" x-rays are generally defined as x-rays with wavelengths shorter than a few Angstroms, while "soft" x-rays have wavelengths of tens of Angstroms or more. For example, carbon K-alpha x-rays have wavelengths of approximately 44 Angstroms, and, thus, are soft x-rays.

There is a class of analytical machines which utilize x-rays to determine the composition and structure of substances. These machines direct a beam of x-rays towards a sample of the substance, and then detect the resultant scattering, reflection, and absorption of the beam with a number of x-ray detectors surrounding the sample. Since different samples have different x-ray scattering, reflecting, and absorbing characteristics, the chemical nature and structure of the sample can be determined by an analysis of the data gathered by the x-ray detectors.

Hard x-rays can be used to analyze the composition and structure of matter having relatively high atomic mass. The hard x-rays are formed within the evacuated chamber and are then beamed out of the chamber through a "vacuum window" and into the sample to be tested. The vacuum window must, therefore, be capable of withstanding continuous x-ray bombardment and a pressure differential of approximately one atmosphere. These prior art, hard x-ray vacuum windows are typically made from a thin, metal foil approximately 50 micrometers thick and having an atomic number (Z) less than 14.

Light elements such as hydrogen or oxygen cannot be detected with hard x-rays because they tend to ionize and otherwise react with the x-rays. Therefore, lower energy, soft x-rays would have to be used to detect light elements. Unfortunately, soft x-rays are not sufficiently energetic to adequately penetrate prior art vacuum windows. For example, a prior art vacuum window which can pass a significant percentage of incident hard x-rays may only pass a fraction of a percent of incident soft x-rays.

One theoretical solution to this problem is to place the sample within the evacuated chamber where the soft x-rays are generated. Unfortunately, this immediately eliminates the possibility of analyzing gaseous samples, since the presence of the gas would destroy the vacuum within the chamber. This solution would, therefore, be limited to the analysis of non-volatile, solid samples which could be safely placed within an evacuated chamber. Even so, this arrangement would be expensive and cumbersome, since it would require an enlarged vacuum chamber, special high-vacuum detectors, portholes, larger vacuum systems, etc.

As noted above, most prior art hard x-ray windows are made from thin, metal foil. Another type of hard x-ray window is described by Smith, et al. in "Prospects for X-Ray Fabrication of Si IC Devices", Journal of Vacuum Science Technology, Vol. 12, No. 6, November/December, 1975. In their paper, Smith, et al, describe a unitary vacuum window structure made from a silicon wafer which includes an annular perimeter, a number of parallel ribs, and a thin silicon membrane supported by the perimeter and reinforced by the ribs.

While the vacuum window of Smith, et al would appear to be satisfactory for use in hard x-ray applications, it would not be possible to make the membrane portion of the window structure thin enough to pass a significant proportion of soft x-rays and still hold one atmosphere of pressure. This is due, in part, to the physical limitations of silicon for this purpose, and is also due to a weakening of the silicon membrane caused by the etching process, which tends to produce pits, grooves, and pinholes.

It is also known from the prior art to make electron permeable vacuum windows from thin membranes of SiC, BN, $B_4C$, $Si_3N_4$ and $Al_4C_3$, see U.S. Pat. Nos. 4,468,282 and 4,494,036.

SUMMARY OF THE PRESENT INVENTION

An object of this invention is to produce a practical x-ray vacuum window which is relatively transparent to soft x-rays.

Another object of this invention is to provide a method for producing a soft x-ray vacuum window.

Briefly, the invention includes a support substrate provided with an aperture, and a membrane formed over the support substrate. The membrane includes a window portion aligned with the aperture having a number of thin pane sections which are relatively transparent to soft x-rays. The thin pane sections are supported and reinforced by a number of relatively thick rib sections attached to a perimeter portion of the membrane.

The substrate should be made from a material having a low atomic number but high tensile strength. Three materials which are suitable for the formation of the membrane of the present invention are boron nitride, boron carbide and silicon carbide.

The method in accordance with the present invention for making a soft x-ray vacuum window includes the steps of: growing a thick, boron nitride membrane on both sides of a silicon wafer; patterning the boron nitride on one side of the silicon wafer to form a window aperture pattern; patterning the boron nitride on the other side of the silicon wafer to form a number of pane openings; depositing a thin layer of boron nitride over the pane openings; and etching a window aperture into the back of the silicon wafer through the window aperture pattern. Since the pane sections are formed by deposition rather than by etching, they are virtually defect-free and have great structural integrity.

An advantage of the present invention is that vacuum windows for x-ray machines can be produced which permit the transmission of soft x-rays.

Another advantage of this invention is that light elements such as hydrogen and oxygen can be detected without placing them inside of a vacuum environment.

These and other objects and advantages of the present invention will be apparent to those skilled in the art after reading the following descriptions and studying the various figures of the drawing.

DETAILED DESCRIPTION OF THE PREFERRED EMBODIMENTS

Figure 1:
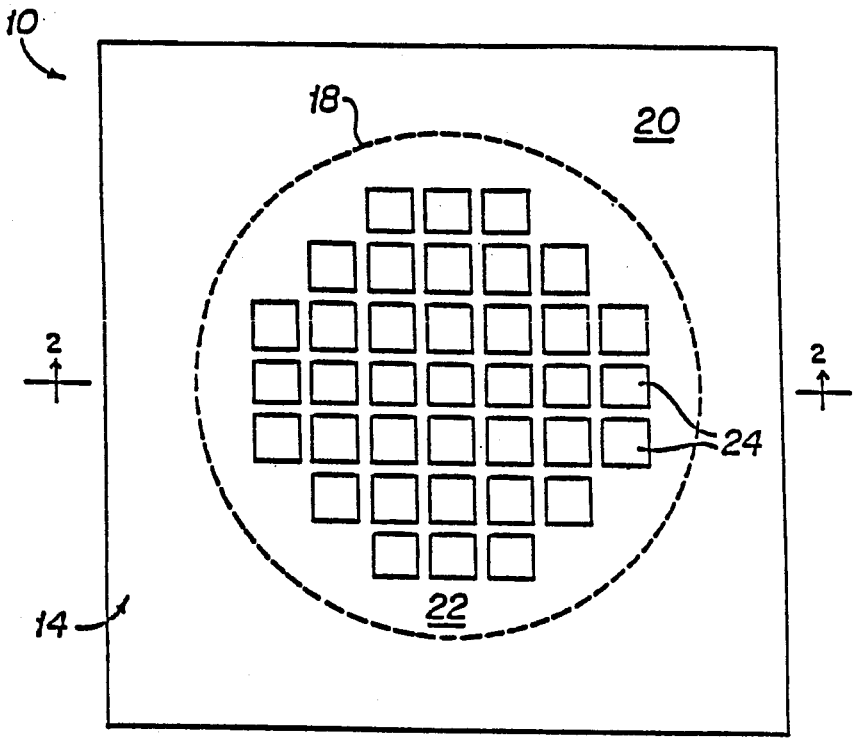
FIG. 1 is a front elevation of a vacuum window for soft x-rays in accordance with the present invention.
Figure 2:
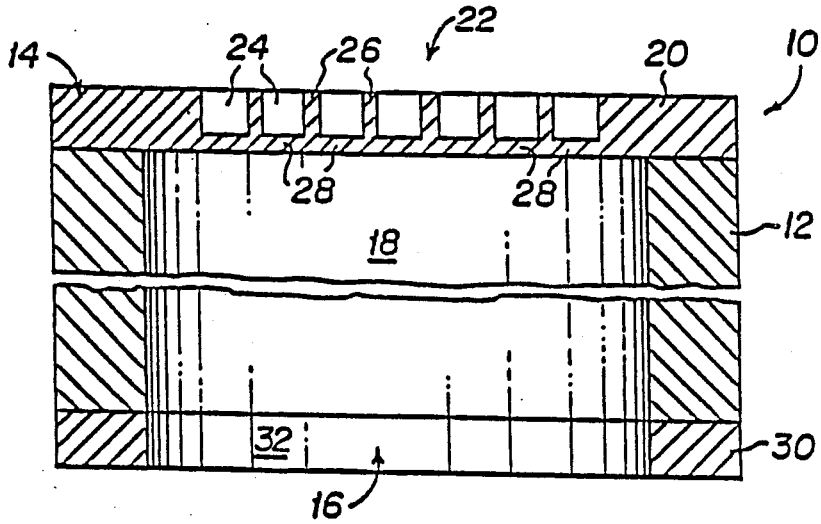
FIG. 2 is a cross-sectional view taken along line 2—2 of FIG. 1.

With reference to FIGS. 1 and 2, a vacuum window 10, in accordance with the present invention, includes a support substrate 12, a front membrane 14, and a back membrane 16. Substrate 12 can be made from many different types of materials including silicon, glass, quartz, sapphire, or tungsten, and is provided with a window aperture 18 which, in the illustrated embodiment, is substantially cylindrical.

The front membrane 14 has a perimeter portion 20 attached to a front surface of substrate 12, and a window portion 22 aligned with window aperture 18. The window portion 22 has a number of pane openings 24 surrounded by a plurality of ribs 26, and a plurality of pane sections 28 formed within pane openings 24.

The back membrane 16 is preferably made from the same material as the front membrane 14, and has a perimeter portion 30 attached to a back surface of substrate 12. Second thick membrane 16 is provided with a cylindrical aperture 32 which is aligned with the window aperture 18.

Three materials that have been found to be suitable membrane material are boron nitride, boron carbide, and silicon carbide. All three of these materials have low atomic numbers and permit the formation of the thin pane sections 28 and thick ribs 26. Taking boron nitride as an example for the membrane material, a 37% transmission rate for soft x-rays can be obtained by making front membrane 14 four micrometers thick at the ribs 26, 0.1 micrometers thick at the pane sections 28, and by making the pane sections 68 micrometers square.

A method for producing a vacuum window in accordance with the present invention starts with the selection and preparation of a suitable substrate material. As mentioned previously, a clean, polished silicon wafer has been found to be a suitable substrate. A relatively thick boron nitride membrane is grown on both sides of the silicon wafer using low-pressure chemical vapor deposition (LPCVD) techniques that are well known to those skilled in the art of integrated circuit manufacturing.

For example, in a preferred embodiment, the boron nitride is deposited on the silicon wafers in a furnace tube at 470° C. at a pressure of 900 m Torr with a flow of 11 standard cubic centimeters per minute (SCCM), of $NH_3$ mixed with 145 SCCM of 10% diborane ($B_2H_6$) in hydrogen dilution gas plus 345 SCCM of hydrogen carrier gas. The silicon wafers are serially arranged relative to axial flow of reactant gases within the furnace tube with the normals to their major face axially aligned with each other and parallel to the axis of revolution of the tube with 2 cm spacing between wafers. The deposition rate is approximately 1 μm per hour and the deposition time is 6 to 8 hours to form a 6 to 8 μm thick layer having a tensile stress of $1\times10^9$ dynes/cm$^2$.

Thereafter, in a preferred embodiment, the wafer is coated by evaporation on both sides with a thin layer, as of 1000 Å of Ni masking material.

Next, a photolithographic process is used to pattern the thick boron nitride on the back side of the substrate to make a window aperture mask. The photolithographic process preferably includes the steps of applying a layer of photoresist to the boron nitride, curing the photoresist in a soft-bake cycle, exposing the photoresist through a suitable mask, developing the photoresist. The exposed nickel mask is patterned by etching in standard aluminum etch. Then, the remaining photoresist is removed. The photolithographic process is, once again, well known to those skilled in the art of integrated circuit manufacturing.

After the window aperture mask is created on the back surface of the wafer, the relatively thick boron nitride on the front surface of the wafer is patterned to produce the pane opening sections and the ribs. At this point, the pane openings extend through the relatively thick front membrane to the upper surface of the silicon substrate.

For example, in a preferred embodiment, a 1 μm thickness of photoresist is spun onto the back side of the nickel-coated wafer. The photoresist is patterned to expose the nickel. Photoresist 1 μm thick is then spun onto the front side of the nickel-coated wafer and patterned with the front side mask to expose the front side nickel through the photoresist.

The wafer is then immersed in a wet etch for the nickel, as of conventional wet aluminum etchant commercially available from KTI of Sunnyvale, California, to expose the boron nitride on both sides of the wafer through the patterned openings in the nickel and photoresist masks.

The boron nitride layers 16 and 14 are then plasma etched to expose the silicon through the boron nitride, Ni and photoresist masks. A suitable plasma etch is 96% $CF_4$ and 4% $O_2$ at 75 watts and 200 m Torr. The front side etch is stopped immediately upon etching through the boron nitride to the silicon so as not to pit or significantly etch the polished silicon surface. A residual gas analyzer is employed for analyzing the gaseous reaction products of the plasma etching process to determine when the silicon starts to be etched. Etching is terminated when these products are detected. The resist and nickel masks are then stripped, and the wafer is cleaned in boiling sulfuric peroxide, to assure particle-free pane openings.

Next, a thin layer of boron nitride is deposited over the front layer of boron nitride to form thin layers or pane sections against the front surface of the wafer at the bottom of the pane openings. The pane sections are very uniform in nature, and are free of such defects as particles, pinholes and fractures because they were formed by deposition rather than by some other, less controllable process such as being etched down from a thicker deposition.

For example, in a preferred embodiment, the thin layer of boron nitride, which forms the pane portions 28 of the x-ray window, is deposited in essentially the same manner as the aforedescribed thick membranes 14 and 16, except that the flow conditions are varied slightly to reduce the tensile stress of the deposited layer to about $2\times10^8$ dynes/cm$^2$. Suitable flow conditions into the furnace tube are 15 SCCM of $NH_3$, 100 SCCM 10% diborane and hydrogen and 385 SCCM hydrogen. The deposition rate is about 1 μm per hour and the deposition time is chosen to deposit between 1000 and 2500 Å boron nitride onto the front surface covering the ribs 26 and exposed silicon at the bottom of the recesses defined between intersecting ribs 26.

Thereafter, the wafer is diced, as by sawing to separate individual x-ray windows 10 from the wafer. The silicon substrate portion remaining under the pane portion 28 supports the pane 28 during the sawing operation and prevents fracture thereof by the sawing slurry and shock and vibration associated with sawing.

Next, a silicon etching acid mixture is used to etch a window aperture through the wafer as defined by the window aperture pattern mask of the back layer of thick boron nitride. Finally, the vacuum window is cleaned and mounted in a suitable holder.

For example, in a preferred embodiment, the individual window die are placed in a holder and immersed in a wet silicon etchant which will not etch the boron nitride. A suitable room temperature silicon etchant is the conventional isotropic silicon etchant consisting of 1 part nitric acid, 1 part hydrofluoric acid, and 2 parts of acetic acid, all by volume and of industry standard concentration. A preferred etchant is the same as above, except without the acetic acid constituent. The industry standard concentration of nitric, HF and acetic are 69–71%, 48–51% and 99.7%, respectively.

In a preferred method for mounting the x-ray window in a suitable holder, the wafer, before dicing, is coated, as by evaporation, on its back side, overlaying the boron nitride layer 16, through a suitable mask with 300–500 Å of either Cr, Ti or Ni, followed by 5000 Å of aluminum.

This back side metallization is confined by the mask to the periphery of the window frame portion. After dicing, individual die are anodically, i.e., thermoelectrically, or electric field assisted, bonded to a Pyrex glass holder having an opening aligned with the back side recess 18 of the x-ray window 10. Typical anodic bonding conditions are 3000 V negative applied to the glass relative to the potential of the silicon substrate 12 for 10 to 20 minutes at 250° to 300° C.

While this invention has been described with reference to a single preferred embodiment, it is contemplated that various alterations and permutations of the invention will become apparent to those skilled in the art upon reading of the preceding descriptions and a study of the drawing. For example, another suitable membrane material for membranes 14 and 16 and panes 28 is silicon nitride. The etchants employed for the boron nitride examples above are also suitable for etching boron carbide, silicon carbide and silicon nitride. The silicon etchants above are also suitable for use with membranes of boron carbide, silicon carbide and silicon nitride.

What is claimed is:

1. A vacuum window for an x-ray device comprising:

support means provided with an aperture;

a membrane covering said aperture and being supported from said support means and said membrane having a window portion aligned with said aperture, where said window portion includes a plurality of pane sections which are relatively transparent to soft x-rays and a plurality of rib sections separating said pane sections; and wherein said rib and pane sections are made of the same material.

2. A vacuum window as recited in claim 1 wherein said support means comprises silicon, glass, quartz, sapphire or tungsten.

3. The window of claim 1 wherein said membrane is made of a material selected from the group consisting of boron nitride, silicon carbide, boron carbide and silicon nitride.

4. The window of claim 1 wherein said rib and pane sections are made of boron nitride.

5. The window of claim 1 wherein said rib and pane sections are made of silicon carbide.

6. The window of claim 1 wherein said rib and pane sections are made of boron carbide.

7. The window of claim 1 wherein said pane sections are in tension and said rib section are in greater tension.

8. The window of claim 1 wherein said rib sections are within the range of 4 to 14 μm deep and said pane sections are 900 to 3000 Å thick.

9. In a method for making a vacuum window for an x-ray device, the steps of:

forming a first membrane over a surface of a substrate;

patterning said first membrane to provide a plurality of pane openings passing completely through said first membrane and terminating on said substrate and being separated by rib portions of said first membrane;

forming a second membrane over said patterned first membrane to define a plurality of pane portions within said pane openings, said pane portions being sufficiently thin to pass a significant portion of soft x-rays and hold one atmosphere of pressure; and forming an aperture passing through said substrate in alignment with said rib and pane portions to define said vacuum window.

10. The method of claim 9 wherein the step of forming said first membrane includes depositing a membrane substance over said surface of said substrate.

11. The method of claim 9 wherein the step of patterning said first membrane includes the step of etching said membrane to form said pane openings.

12. The method of claim 9 wherein the steps of forming said first and second membranes includes the step of forming said first membrane with a tension stress greater than that of said second membrane.

13. The method of claim 9 including the step of selecting said first and second membranes from a material selected from the group consisting of boron nitride, silicon carbide, boron carbide and silicon nitride.

14. The method of claim 9 wherein said substrate is a wafer and wherein the step of patterning said first membrane includes the step of patterning said first membrane to define a plurality of vacuum window patterns each having a plurality of pane openings separated by rib portions; and including the step of dicing the wafer to form individual vacuum window die after the step of forming the second membrane and before forming the aperture passing through said die substrate, such that the pane portions are not damaged by the dicing step.

15. The method of claim 9 wherein said first and second membranes are of boron nitride.

* * * * *